United States Patent [19]

Okumura

[11] Patent Number: 4,480,787

[45] Date of Patent: Nov. 6, 1984

[54] RAIL FASTENING DEVICE

[76] Inventor: Shuichi Okumura, 7-9, Ohmachi 7-chome, Kamakura-shi Kanagawa, Japan

[21] Appl. No.: 420,063

[22] Filed: Sep. 20, 1982

[30] Foreign Application Priority Data

Jul. 28, 1982 [JP] Japan ..... 57-130298

[51] Int. Cl.[3] ..... E01B 9/62

[52] U.S. Cl. ..... 238/264; 238/284; 238/289; 238/299; 238/304; 238/307; 248/560; 248/618

[58] Field of Search ..... 238/82, 264, 272, 274, 238/283, 284, 287, 290, 291, 299, 304, 307, 269–271, 273, 289; 248/560, 618

[56] References Cited

U.S. PATENT DOCUMENTS

| | | | |
|---|---|---|---|
| 681,508 | 8/1901 | Raby | 238/269 X |
| 858,516 | 7/1907 | Inderlied | 238/82 |
| 1,054,660 | 3/1913 | Abbott | 238/284 X |
| 1,188,660 | 6/1916 | Kessler | 238/274 X |
| 1,632,998 | 6/1927 | Coughlin | 238/289 X |
| 1,788,040 | 1/1931 | Yseboodt | 238/304 |

FOREIGN PATENT DOCUMENTS

| | | | |
|---|---|---|---|
| 2718665 | 11/1978 | Fed. Rep. of Germany | 238/59 |
| 600095 | 3/1948 | United Kingdom | 238/269 |

*Primary Examiner*—Randolph Reese

*Attorney, Agent, or Firm*—Flynn, Thiel, Boutell & Tanis

[57] ABSTRACT

Disclosed is a rail fastening device particularly suitable for fastening a long rail to a wooden tie, comprising: a flat bellows-shaped intermediate member having tie-mounting parts provided at constant distances; a spike member for securing each of the tie-mounting parts to a tie; a bolt for securing a rail to the intermediate member; and a plate spring clip adapted to strongly hold the base portion of the rail supported by the bolt.

9 Claims, 7 Drawing Figures

RAIL FASTENING DEVICE

BACKGROUND OF THE INVENTION

The present invention relates to a rail fastening device particularly suitable for fastening a long rail to a wooden tie.

In general, a rail is secured to a tie or a roadbed by such a way that a tie plate is placed on the tie or a concrete roadbed, and the rail is placed on the tie plate, which is secured to the tie or the concrete roadbed by means of a screw spike or a dog spike, and the rail is secured to the tie plate by means of a plate spring clip. In this case, such a tie plate as shown in FIG. 1 is generally used. Namely, the tie plate 1 is made of carbon steel and formed into a plate shape having slight unevenness in height as a whole, the central portion thereof being a rail-mounting surface 2.

There are provided, at both end portions of the tie plate 1, bores 3 for receiving screw spikes or dog spikes respectively. The tie plate 1 is adapted to be secured to a tie, not shown, by means of the screw spikes or the dog spikes inserted through the bores 3. In addition, a bore 4 for implanting a bolt, not shown, is provided between the bores 3 at end of the end portions of the tie plate 1. A U-shaped plate spring clip, not shown, held by the bolts implanted in the bores 4 respectively supports the base portion of a rail, now shown, mounted on the rail-mounting surface 2.

When the supporting means for the rail is a tie, the conventional tie plate 1 having such a shape as mentioned above is manufactured so that its width dimension is within that of the tie, and provided to each of the right and left sides of the tie so as to support each of right and left rails. The conventional tie plate 1, however, has the following disadvantages:

(1) Although carbon steel is employed as material, as mentioned above, in order to sufficiently endure the bending moment generated in the tie plate, it needs to increase its weight in proportion to increase in the unit weight of the rail in correspondence with increase in the axle load of trains and passing tonnage on it. Therefore, not only the material cost becomes high, but also a large equipment and a high cost are needed for fabrication to produce the tie plate from a long rolled material, so that the cost-performance rate is rapidly lowered.

(2) Since the ratio of area to weight is large, the working efficiencies and working properties are not good in a series of handling operations, such as fabrication, packing, transportation, storage, laying, removal and the like.

(3) Owing to the basic structure, the function is limited to the known one, so that there are no indications of its future development.

SUMMARY OF THE INVENTION

It is, therefore, an object of the present invention to provide an intermediate member replacing the conventional tie plate having the above-mentioned disadvantages, thereby to effectively fasten a long rail to a wooden tie.

DETAILED DESCRIPTION OF THE PREFERRED EMBODIMENTS

Figure 1:
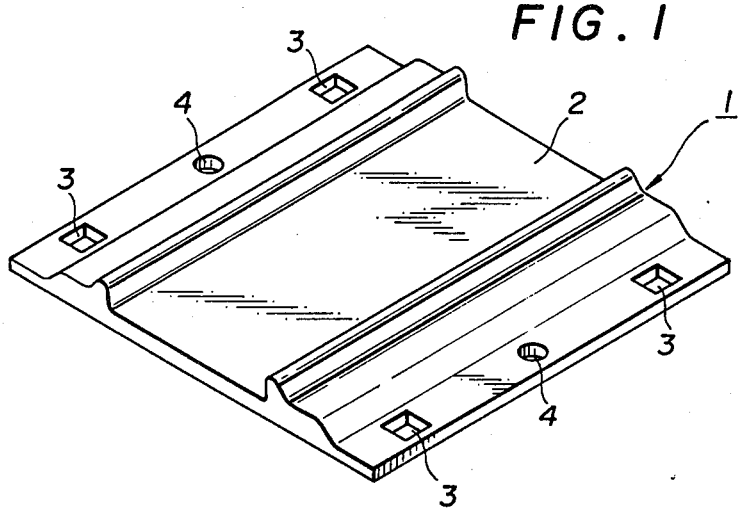
PRIOR ART FIG. 1
FIG. 1 is a perspective view of a conventional tie plate.
Figure 2:
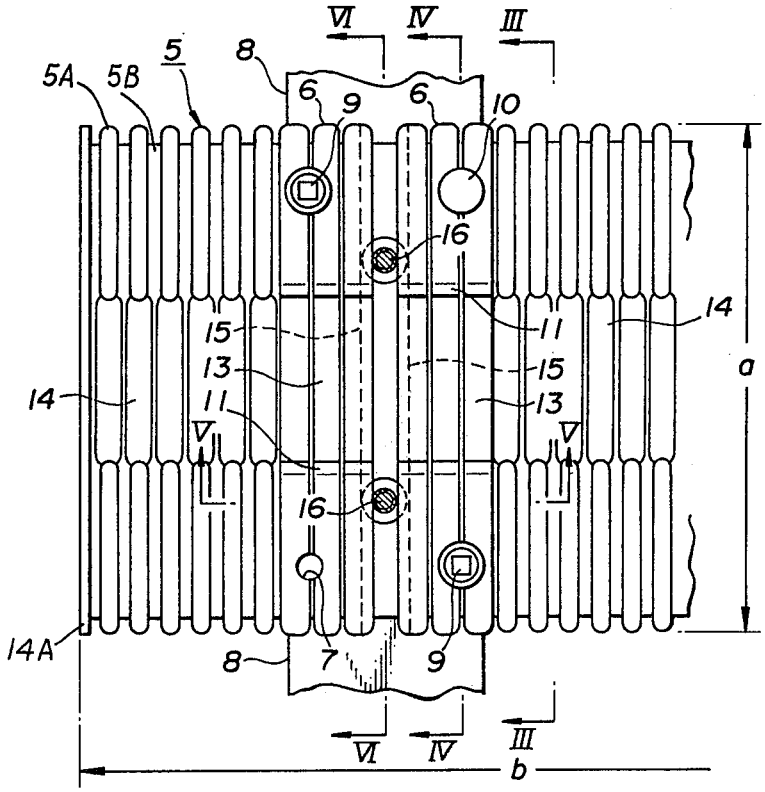
FIG. 2 is a plan view of an intermediate member in accordance with a preferred embodiment of the present invention.
Figure 3:
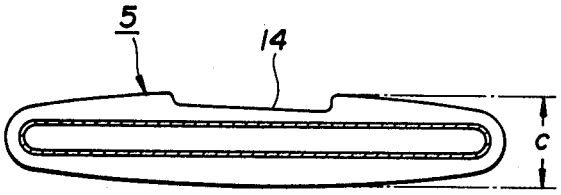
FIG. 3 is a sectional view taken along a line III—III of FIG. 2.
Figure 4:
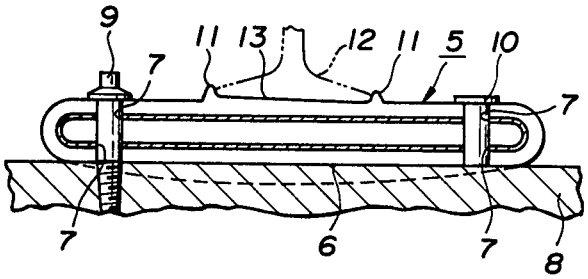
FIG. 4 is a sectional view taken along a line IV—IV of FIG. 2.
Figure 5:
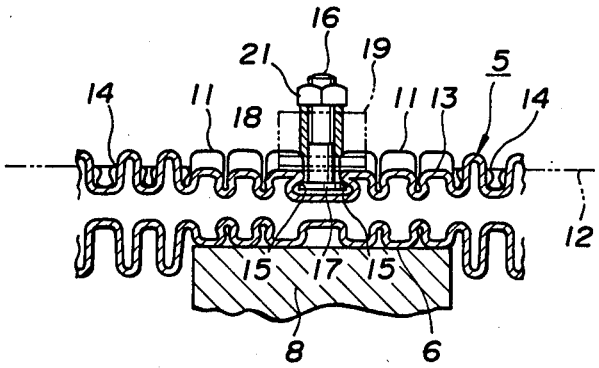
FIG. 5 is a sectional view taken along a line V—V of FIG. 2.

A preferred embodiment of the present invention will be described hereinunder with reference to infra FIG. 2. FIG. 2 shows an intermediate member 5 replacing conventional tie plates. The intermediate member 5 is made of a metal material and formed into a flat bellows shape (see FIG. 3) having, for example, a width (a) of about 500 mm, a length (b) of about 6,000 mm and a thickness (c) of about 90 mm. More particularly, as seen in FIGS. 2 and 5, the flat bellows-shaped intermediate member 5 is of flattened tubular configuration including circumferentially extending ridges 5A and valleys 5B alternating along the length of the intermediate member 5. The intermediate member 5 has tie-mounting portions parts, 6 provided therein at constant distances i.e. the tie-mounting portions 6 in a given intermediate member are spaced therealong at preset intervals. As shown in FIG. 4 and FIG. 5, each tie-mounting part 6 has flat upper and lower surfaces and is provided four bores 7 for receiving screw spikes 9 (dog spikes may be employed) to be mounted to a tie 8. A cover 10 is used to close the bore 7 not receiving any screw spike 9.

As shown in FIG. 4, shoulders 11 are formed on the upper surface of the tie-mounting part 6, the shoulders 11 being disposed on a rail-mounting surface 13 so as to sandwich the base portion of the rail 12. The portion of the intermediate member 5 other than the tie-mounting part 6 is formed into a bellows shape slightly swelling from the tie-mounting part 6 in the vertical direction as shown in FIG. 5. In addition, a groove 14 is provided in the center of one surface (the upper surface in use) of this portion, as shown in FIG. 2 and FIG. 3, so as to receive the base portion of the rail 12, together with the rail-mounting surface 13.

The intermediate member 5 is adapted to secure the rail 12 through the portion of the tie-mounting part 6. Therefore, the tie-mounting part 6 needs to support bolts upwardly. In description of a structure therefore, as shown in FIG. 5, a groove 15 is provided in the center of the tie-mounting part 6 in the direction perpendicular to the longitudinal direction of the intermediate member 5. Heads 17 of bolts 16 respectively engage with the groove 15, thereby to allow threaded parts 18 of the bolts 16 respectively to be directed upwardly. The head part 17 of each bolt 16 is slid into the groove 15 in the vertical direction of FIG. 2 so as to be fitted therein.

As shown in FIG. 2, the end of the bellows-shaped portion at the end of the intermediate member 5 is compressed in the longitudinal direction (as indicated at 14A) in the left bottom of FIG. 2 so as to readily join with the adjacent similar end of another intermediate member not shown The ends of the adjacent intermediate members are connected with each other by means of spot welding or the like.

Figure 6:
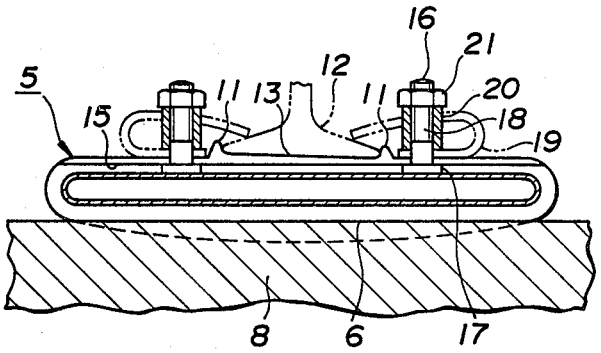
FIG. 6 is a sectional view taken along a line VI—VI of FIG. 2.

The structure for fastening the rail 12 by the use of the intermediate member 5 thus arranged will be described hereinunder with reference to FIG. 6 which is a sectional view taken along a line VI—VI of FIG. 2. As described with reference to FIG. 5, the intermediate member 5 has the bolts 16 secured in such a posture that the threaded parts 18 thereof are directed upwardly, and the intermediate member 5 itself is secured to the tie 8 by means of the screw spikes 9 as shown in FIG. 4. Provided to the threaded part 18 of each bolt 16 is a plate spring clip 19 supported by the threaded part 18 and adapted to strongly hold the base portion of the rail 12 with its end portion. The structure of this portion has no difference from the conventional one. A reference numeral 20 designates a sleeve fitted on each bolt 16, while 21 denotes a nut. The fastening of the rail 12 to the intermediate member 5 is thus performed in the central portion of the tie-mounting part 6.

Figure 7:
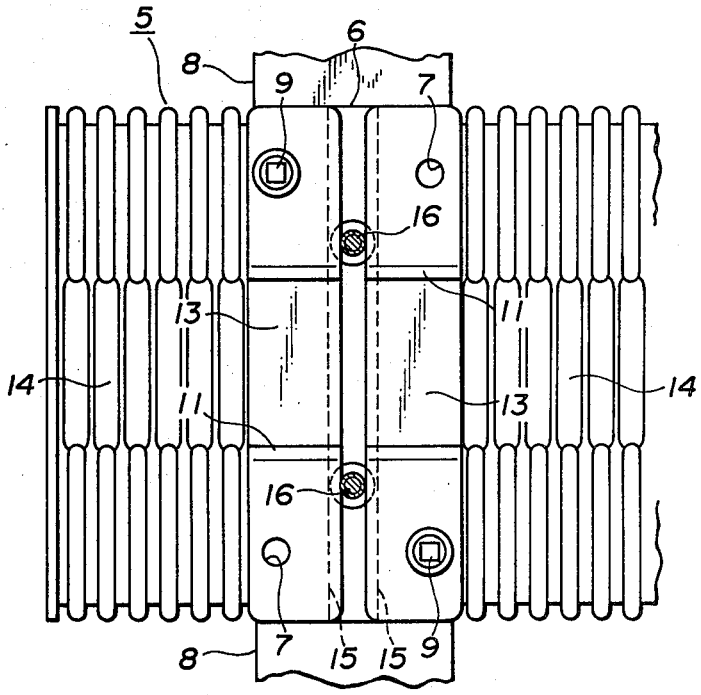
FIG. 7 is a plan view of an intermediate member in accordance with another preferred embodiment of the present invention.

In the preferred embodiment described above, although the tie-mounting part 6 has three lines of belt-shaped portions formed on each of the right and left sides from the center, as shown in FIG. 2, it is unnecessary to bend the tie-mounting part 6 in accordance with the curvature of the rail 12 even at a curved block because the length of the tie-mounting part 6 is short enough to be neglected. Therefore, such a structure may be employed that the tie-mounting part 6 has a single plane provided with only the groove 15, in the center, to be engaged with the bolts 16, like another preferred embodiment of the present invention shown in FIG. 7. The other portions have no difference from those shown in FIG. 2.

As described above, the rail fastening device according to the present invention comprises the flat bellows-shaped intermediate member 5 having the tie-mounting parts 6 provided at constant distances, the spike members (screw spikes or dog spikes) for securing each tie-mounting part 6 of the intermediate member 5 to the tie 8, the bolts 16 for securing the rail 12 to the intermediate member 5 and the plate spring clip 19 supported by each bolt 16 and adapted to strongly hold the base portion of the rail 12, and replacing conventional tie plates, the intermediate members 5 are placed under the rail 12 over an infinitely long distance. Accordingly, there are provided the following various effects as compared with conventional tie plates:

(1) It is possible to employ as material nonmetals besides steel stock and non-ferrous metals. When steel stock is employed, it becomes possible to manufacture intermediate members having mechanical strength and durability substantially equal to those of conventional tie plates by using extremely thin plate material, so that the cost-performance rate improves.

(2) It becomes possible to continuously lay the intermediate members in accordance with a curved block although each intermediate member has a long shape along the rail, since the intermediate member itself has flexibility owing to the bellows-shaped tubular body which constitutes the principal structure. Accordingly, the rigidity of the joint between the rail and the tie improves and also the roadbed resistance largely increases, so that it becomes possible to lay long rails in almost all wooden ties sections.

(3) Since ordinary thermal effects on the intermediate member are absorbed by the bellows-shaped portion, the thermal effects on the intermediate member itself and the associated members become small enough to be substantially neglected in both cases where the intermediate member is employed as a single body and where the intermediate members are continuously laid.

(4) Since the intermediate member is continuously contacted with the base portion (bottom) of the rail, the heat from the rail is readily conducted thereto (when the intermediate member is made of metal) and the bellows-shaped portion functions also as a radiator. Accordingly, it is possible to reduce the thermal effects of the rail itself.

(5) Since the intermediate member is a bellows-shaped tubular body, it is highly effective in sound-proofing and vibration-proofing. Accordingly, it is possible to obtain an effect substantially equal to that of a conventional rail double resilient fastening device without employing any track pad. Moreover, the rail anti-creep effect improves.

(6) Although conventional steel tie plates need hot working, cold working is made possible for fabrication according to the present invention because the wall thickness of the steel stock can be made thinner.

(7) Since the ratio of area to weight is small and the unit length is long as compared with conventional tie plates, it is possible to improve the working efficiencies and working properties all over such operations as fabrication, packing, transportation, storage, laying, removal and the like. Accordingly, the product cost can be reduced.

(8) Maintenance and care are facilitated and the costs thereof can be largely reduced, since it is possible to allow a single kind of device to cope with all kinds of track block, such as straight, curved and sharply curved blocks and a grade, and all kinds of climate and topography, such as the frigid zones, the torrid zone, snowy areas, rainy and humid areas, dry desert areas, mountaneous districts and littoral districts.

(9) If a portion of the intermediate member has a trouble after laying, repair and replacement can be readily performed without damaging the safety of the track.

(10) Employing a suitable structure permits a plurality of fastening units to be extremely readily operated at a single portion, so that it is possible to largely reduce the number of steps needed in the operations for laying, removing and replacing rails.

(11) The hollow portion of the tubular body can be used also as a protecting tube for cables.

What is claimed is:

1. A rail fastening device for supporting a rail on a plurality of spaced ties, comprising: an elongate, flat bellows-shaped, intermediate member incorporating a plurality of tie-mounting portions spaced therealong at preset intervals for engaging spaced ties; a spike member for securing each of said tie-mounting portions of the intermediate member to a corresponding one of a plurality of ties; a bolt for securing a rail to said intermediate member; and a plate spring clip biased by said bolt to strongly hold the base portion of said rail to the corresponding one of the tie-mounting portions of the intermediate member.

2. A rail fastening device as defined in claim 1, wherein said intermediate member includes a plurality of bellows-shaped portions alternating along the length of said intermediate member with said tie-mounting portions, each of said spaced tie-mounting portions having a surface flatter than and a thickness smaller than that of the bellows-shaped portions located between said tie-mounting portions.

3. A rail fastening device as defined in claim 1, including a bore for receiving said spike member and provided between shoulders of the bellows-shape in each of said tie-mounting portions of said intermediate member.

4. A rail fastening device as defined in claim 1, wherein each of said tie-mounting portions has an undercut groove running perpendicular to the longitudinal direction of said intermediate member between shoulders of the bellows-shape of said intermediate member, with which groove is engaged the head of said bolt for securing said rail.

5. A rail fastening device as defined in claim 1, including a groove in and along the center of the upper surface of said intermediate member both through and between the tie-mounting portions for receiving the base portion of a rail supported on said intermediate member.

6. A rail fastening device as defined in claim 1, wherein said intermediate member includes a plurality of bellows-shaped portions alternating along the length of said intermediate member with said tie-mounting portions, a said bellows-shaped portion defining an end of said intermediate member, a said bellows-shaped portion being of longitudinally alternating, circumferentially extending, ridge and valley configuration with a part of that configuration at said end of said intermediate member being longitudinally compressed to facilitate joining to an adjacent intermediate member.

7. A rail fastening device for supporting a rail on a plurality of spaced ties, comprising an elongate tubular intermediate member of flattened diametral cross section, said tubular intermediate member being essentially bellows-shaped in which the peripheral wall of the tubular intermediate member is formed with a plurality of circumferentially extending ridges and valleys alternating along the length of said tubular intermediate member, said intermediate member incorporating a plurality of tie mounting portions spaced therealong at preset intervals, said ridges in a said tie mounting portions including flattened parts for receiving a tie extending transversely of the axis of said intermediate member, said ridges in the upper face of the intermediate member both on and between ties having portions depressed for supporting and sidewardly locating a rail extending along the axis of said intermediate member, and means at said tie mounting portions for securing same to an underlying tie and overlying rail.

8. A rail fastening device as defined in claim 7 in which the intermediate member is due to the tubular bellows-shape thereof flexible in plan sufficient to conform to the curvature of a curved block of track, is flexible in elevation sufficient to accommodate changes in grade of track, and is flexible in length sufficient to accommodate thermal expansion and contraction of a rail carried thereon.

9. The apparatus of claim 7 in which said intermediate member is open longitudinally from end to end and through the ends thereof and hence along the length direction of a rail to be supported thereon.

* * * * *